US012753605B2

(12) United States Patent
Noca

(10) Patent No.: US 12,753,605 B2
(45) Date of Patent: Oct. 6, 2026

(54) WALL PANEL AND METHOD FOR MANUFACTURING SUCH A WALL PANEL

(71) Applicant: CARBON CAPTURE BUILDINGS GREENTECH, Beaurepaire (FR)

(72) Inventor: Laurent Noca, Hauterives (FR)

(73) Assignee: CARBON CAPTURE BUILDINGS GREENTECH, Beaurepaire (FR)

( * ) Notice: Subject to any disclaimer, the term of this patent is extended or adjusted under 35 U.S.C. 154(b) by 84 days.

(21) Appl. No.: 18/685,936

(22) PCT Filed: Aug. 23, 2022

(86) PCT No.: PCT/EP2022/073529

§ 371 (c)(1),
(2) Date: Feb. 23, 2024

(87) PCT Pub. No.: WO2023/025826

PCT Pub. Date: Mar. 2, 2023

(65) Prior Publication Data

US 2024/0352732 A1 Oct. 24, 2024

(30) Foreign Application Priority Data

Aug. 23, 2021 (FR) ..... 2108835

(51) Int. Cl.
*E04C 2/00* (2006.01)
*E04B 1/10* (2006.01)
(Continued)

(52) U.S. Cl.
CPC ..... *E04C 2/386* (2013.01); *E04B 1/10* (2013.01); *E04B 1/80* (2013.01); *E04C 2/46* (2013.01)

(58) Field of Classification Search
CPC ... E04C 2/26; E04C 2/28; E04C 2/284; E04C 2/38; E04B 1/26
See application file for complete search history.

(56) References Cited

U.S. PATENT DOCUMENTS

2016/0069063 A1* 3/2016 Harvey ..... E04B 1/343
2017/0218635 A1* 8/2017 O'Leary ..... E04F 13/04
(Continued)

FOREIGN PATENT DOCUMENTS

BE 395 384 A 4/1933
EP 2 442 002 A1 4/2012
(Continued)

OTHER PUBLICATIONS

Dec. 7, 2022 International Search Report issued in International Patent Application No. PCT/EP2022/073529.
(Continued)

*Primary Examiner* — Joshua J Michener
*Assistant Examiner* — Henry Hooper Mudd
(74) *Attorney, Agent, or Firm* — Oliff PLC

(57) ABSTRACT

A wall panel includes a frame provided with vertical battens. The frame defines a plurality of holes. A connecting plate is formed by a mixture of a curable material in which organic plant-derived elements are embedded. The wall panel includes a thermal insulation layer. A facing layer is separated from the connecting plate by the frame and thermal insulation layer. A plurality of connectors are fixed to the frame. Each connector has a salient area spaced apart from the frame and embedded in the connecting plate. The connecting plate partially overlaps the vertical battens in the thickness direction, the connecting plate forming wood-concrete studs that partially fill the plurality of holes.

17 Claims, 5 Drawing Sheets

(51) Int. Cl.

| | |
|---|---|
| ***E04B 1/80*** | (2006.01) |
| ***E04B 2/00*** | (2006.01) |
| ***E04C 2/38*** | (2006.01) |

(56) References Cited

U.S. PATENT DOCUMENTS

| | | | | |
|---|---|---|---|---|
| 2020/0256054 | A1 | 8/2020 | VanHoose et al. | |
| 2022/0205242 | A1* | 6/2022 | Malinowski | E04C 2/38 |
| 2022/0412081 | A1* | 12/2022 | Giles | E04B 2/84 |

FOREIGN PATENT DOCUMENTS

| | | | |
|---|---|---|---|
| EP | 3 854 958 | A1 | 7/2021 |
| FR | 2 909 695 | A1 | 6/2008 |
| FR | 3 004 711 | A1 | 10/2014 |

OTHER PUBLICATIONS

Dec. 7, 2022 Written Opinion issued in International Patent Application No. PCT/EP2022/073529.

* cited by examiner

WALL PANEL AND METHOD FOR MANUFACTURING SUCH A WALL PANEL

BACKGROUND OF THE INVENTION

The invention relates to a wall panel and to a method for manufacturing such a wall panel.

STATE OF THE ART

When constructing a building, it is extremely important to construct walls presenting a high thermal insulation to improve the energy efficiency of the building. The tendency is especially to construct walls with an increasingly high thermal insulation with the use of an increasingly effective thermal insulation layer.

It is also known to erect the main structure of a building and to then subsequently install the thermal insulation layers on the inside and/or on the outside. In conventional manner, the walls are formed by several layers each having a specific function. The load-bearing wall is constructed from masonry with concrete blocks or by casting concrete or reinforced concrete. A frame is subsequently fixed to the load-bearing wall by screw-fastening or applied against the supporting wall by fixing on the floor or the ceiling. The frame forms recesses designed to receive a thermal insulation layer and to keep the thermal insulation layer in the required configuration. A facing layer is subsequently fixed to the frame to form the internal façade wall of the construction and block the thermal insulation layer.

The frame can be formed by metal rails or by wooden battens that are screwed into the supporting wall or applied against the supporting wall with other fastening means. The frame does not provide any mechanical structural support. An identical solution can be used to fix an external partition provided with an insulating layer. The sole purpose of the frame is to secure the thermal insulation layer. It is also known to bond the insulating layer to the supporting wall to form the internal partition.

Walls are also known with wooden frames made up from box-sections or interlinked compartments and solid structural panels (made from wood or concrete) with a thermal insulation layer bonded thereto. The frame forms the supporting structure and the cavities that receive the thermal insulation layer. This configuration of "ready-to-use" wall is limited in its use due to the strength of the wood frame and/or the weight added by the concrete panels.

In any case, erection of a thermally insulating partition on the inner or outer surface after the supporting wall has been formed implies a non-negligible implementation time. It is necessary to call on professionals from different trades and to organise technical exchanges between the latter to avoid handling operations that may damage the structure and/or the quality of the thermal insulation, the air insulation and water insulation.

Prefabricated elements are also known that are supplied fully assembled on the worksite. Provision of a complete prefabricated structure on site makes it possible to speed up the work completion time, improve the quality, reduce the arduousness of the work and optimise the site organisation with less manpower. The prefabricated element has a floor and several side walls. The supporting structure of the prefabricated element is made entirely from reinforced concrete thus making it a heavy structure that is difficult to install. Once the structure has been formed, the inner surface of the walls is covered by the inner partition so as to provide a complete "ready-to-use" structure on site. As for the previous embodiments, a frame is fixed on the supporting structure to secure the thermal insulation layer and the facing layer before the prefabricated element is transported.

Configurations can also be cited in which the walls are concrete double-skin walls with an insulation integrated between the two skins.

Although prefabricated elements present advantages, they do have numerous shortcomings. The large weight of the structure can be cited, making handling of the panels complicated. There are also difficulties of compatibility of surface finishings, fire resistance, thermal inertia or sealing management. All these shortcomings considerably limit the incitement to use "ready-to-use" prefabricated panels.

SUMMARY OF THE INVENTION

One object of the invention consists in providing a wall panel designed for a construction having a limited weight to make the panel easier to handle, while being compatible with construction of several storeys and providing improved performances as regards thermal insulation and fire resistance.

This result tends to be achieved by means of a wall panel that comprises:

- a frame provided with a plurality of vertical battens made from wood extending mainly in a vertical direction and a plurality of horizontal battens extending mainly in a horizontal direction, each vertical batten being fixed to at least two of the horizontal battens, the frame defining a plurality of re-entrants, the frame having a vertical compressive strength at least equal to 15 tonnes per linear metre of frame;
- a connecting plate formed by a first mixture comprising a curable material in which organic plant-derived elements are embedded, the connecting plate connecting all the vertical battens and all the horizontal battens, the organic plant-derived elements representing at least 70% of the volume of the connecting plate;

wall panel wherein the connecting plate partially and continuously overlaps the vertical battens in a thickness direction that is perpendicular to the horizontal direction and perpendicular to the vertical direction, the connecting plate having a shell arranged salient from the frame in the thickness direction and studs salient from the shell, the studs partially filling the plurality of re-entrants, the connecting plate having a vertical compressive strength at least equal to 1 MPa.

In a particular embodiment, the connecting plate is fixed to the frame by means of a plurality of connectors. Advantageously, the connecting plate is fixed to all the vertical battens. In even more advantageous manner, the connecting plate is fixed to all the horizontal battens.

Preferentially, each connector has a salient area arranged at a distance from the frame, the salient area being embedded in the connecting plate.

In an advantageous embodiment, the thickness of the shell is at least equal to 5 cm.

In a preferential embodiment, the studs extend over at least 20% of the depth of the re-entrant.

In advantageous manner, the re-entrant is filled by a thermal insulation plate.

It is advantageous to provide for the wall panel to comprise an additional frame fixed to the frame and separated from the connecting plate by the frame, the additional frame comprising only horizontal battens, a facing plate being fixed to the additional frame.

Preferentially, one of the horizontal battens forms a bottom wall plate, the wall panel being pressing on the support formed by the bottom wall plate.

In an advantageous embodiment, one of the horizontal battens forms a top wall plate extending continuously from one end of the connecting plate to the other.

In a preferential configuration, the connecting plate extends beyond the top wall plate in the vertical direction.

It is a further object of the invention to provide a construction that is easy to erect by means of prefabricated supporting construction panels.

This result tends to be achieved by means of a construction comprising a first wall panel according to the foregoing configuration in which a slab is placed on the upper wall plate and in which a second wall panel according to one of the foregoing configurations is placed on the slab, the bottom wall plate of the second wall panel being installed bearing on the slab.

According to another feature, a method for manufacturing a wall panel is proposed that is easy to implement. This result tends to be achieved by means of a method comprising the following successive steps:

providing a frame provided with vertical battens made from wood and horizontal battens, the frame defining holes, the frame having a vertical compressive strength at least equal to 15 tonnes per linear metre of frame;

providing blanking plates;

casting a first mixture of a curable material in which organic plant-derived elements are embedded, the mixture being cast in a mould in which the frame is installed with the blanking plates partially filling the holes of the frame, the mixture being cast to form a connecting plate connecting all the vertical battens and all the horizontal battens, the organic plant-derived elements representing at least 70% of the volume of the connecting plate;

in which the connecting plate partially and continuously overlaps the vertical battens in a thickness direction that is perpendicular to the horizontal direction and perpendicular to the vertical direction, the connecting plate having a shell arranged salient from the frame in the thickness direction and studs salient from the shell, the studs partially filling the plurality of re-entrants, the connecting plate having a vertical compressive strength at least equal to 1 MPa.

DESCRIPTION OF THE DRAWINGS

Other advantages and features will become more clearly apparent from the following description of particular embodiments and implementation modes of the invention given for non-restrictive example purposes only and represented in the accompanying drawings, in which.

DETAILED DESCRIPTION

Figure 1:
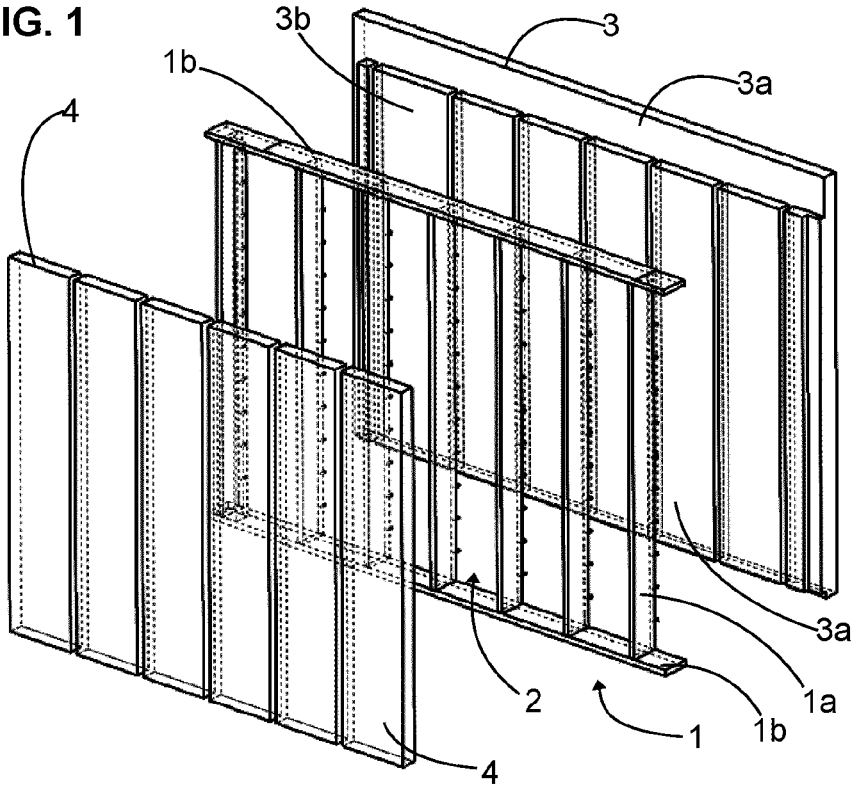
FIG. 1 schematically illustrates an exploded view of a first embodiment of a wall panel.

As illustrated in FIG. 1, in exploded view, the wall panel comprises a frame 1 in the form of the vertical battens 1*a* made from wood that are joined to one another by the horizontal battens 1*a*. The horizontal battens 1*a* have at least a top rail and a bottom rail that are fixed to the vertical battens 1*a*. The bottom rail and top rail can be made independently from wood and/or metal. The frame 1 provides a higher mechanical strength than a threshold value, in particular a compressive strength of more than 1 MPa. The threshold value required for the frame 1 depends on the projected mechanical performances for the building to be constructed, and in particular the number of storeys to be supported. The higher the threshold value, the more the vertical battens 1*a* with large cross-sections and/or the more the vertical battens 1*a* the frame 1 has. The wall panel is a load-bearing wall panel, i.e. a wall panel that is designed to support a roof and possibly one or more additional storeys. The number of the vertical battens 1*a* and the cross-section of the vertical battens 1*a* vary according to the vertical forces the wall panel has to withstand.

The vertical battens 1*a* made from wood are spaced apart from one another to define a plurality of re-entrants 2. The vertical battens 1*a* extend mainly or solely in a vertical direction once the wall panel has been installed. The horizontal battens 1*a* extend mainly or solely in a horizontal direction once the wall panel has been installed.

In preferential manner, the vertical battens 1*a* have a minimum cross-section that is larger than 1800 $mm^2$ and advantageously larger than 3000 $mm^2$, and more preferentially they have a minimum width at least equal to 12 mm and advantageously larger than 20 mm, and a minimum thickness that is at least equal to 60 mm and preferably at least equal to 100 mm. The cross-section is measured in a horizontal plane. Such a minimum cross-section enables the vertical battens 1*a* to be formed that are able to support several storeys. The vertical battens 1*a* are made from wood and preferentially from solid wood or from slats made from wood of plywood type. To form a load-bearing wall panel that is designed to support a roof and possibly several storeys, it is advantageous to provide a frame having a vertical compressive strength that is greater than or equal to 15 tonnes per linear metre of frame, advantageously greater than or equal to 20 tonnes per linear metre of frame. The length of the frame is measured in the longitudinal direction of the horizontal battens 1*a*. The thickness of the battens is measured perpendicularly to a plane that contains the vertical direction and the longitudinal direction of the horizontal battens 1*a*.

The wall panel also comprises a connecting plate 3 formed by a first mixture of a curable material in which organic plant-derived elements are embedded. The connecting plate 3 is a plate made from a mixture containing a curable material in which organic plant-derived elements are embedded. An organic plant-derived element can be wood, straw, cellulose, rice husks, bamboo chips, hemp or cork.

An organic element comprises carbon obtained naturally so as to have a favourable carbon balance. It is preferable to use an organic plant-derived element that is mainly constituted by wood.

The mixture comprises at least 40% by volume of organic plant-derived elements enabling a mixture having a low density to be formed thus enabling a wall panel to be formed having a lower weight than its equivalent made from concrete or reinforced concrete. In preferential manner, the connecting plate 3 has at least 70% by volume of organic plant-derived elements.

Preferentially, the organic plant-derived elements are wood elements. The wood elements can be wood chips having a length of less than 75 mm, preferentially comprised between 10 and 75 mm, and even more preferentially between 20 and 60 mm. For example, as regards the total mass of the wood elements, the wood-concrete comprises between 80% and 95% of wood elements having a length comprised between 10 and 60 mm, preferably between 20 and 60 mm.

More particularly, these wood chips have a thickness comprised between 1 mm and 5 mm. When wood chips having a length comprised between 20 and 60 mm are used, microcavities are obtained at the surface of the façade panel 3*a*/3*b* due to the fact that the concrete coats the wood chips. Such microcavities enhance adhesion of a surface coating on the inner surface and/or the outer surface of the wall panel.

Preferentially, the curable material comprises a hydraulic binder, i.e. a binder that reacts with water to harden. In other words, to obtain the curable material, the hydraulic binder is mixed with water. When the material dries, it hardens by chemical reaction between the binder and water. The binder is for example a cement or lime. For example, the curable material is a mortar. The mortar is made from cement or lime and can comprise sand or not. In preferential manner, the wall panel is made from wood-concrete, i.e. a mixture comprising a mortar in which wood elements are embedded.

The connecting plate 3 mechanically connects all the vertical battens 1*a* and also top and bottom rails 1*b* so as to form the bracing of the frame 1. The association of the frame 1 with the connecting plate 3 forms a wall panel that presents a better compressive strength than the frame 1 alone and than the connecting plate 3 alone. This technical solution presents a better trade-off between mechanical performances, size, weight and thermal performances of the wall panel. The connecting plate 3 presents a vertical compressive strength that is at least equal to 1 MPa, preferentially at least equal to 2 MPa.

The thickness of the connecting plate 3 is chosen according to the vertical stresses the wall panel has to withstand and the forces applied by any external cladding and/or any other element that is fixed to the connecting plate 3.

The frame 1 with its wooden vertical battens 1*a* has a compressive strength in the vertical direction that is higher than the value of the compressive strength of the material forming the first mixture. The compressive strength value corresponds to the value above which the material breaks under a compressive stress.

The connecting plate 3 forms a shell 3*a* and a plurality of the salient studs 3*b*. The shell 3*a* is salient from one surface of the frame 1. The studs 3*b* are salient from the shell 3*a* in the direction of the frame 1 and partially fill the re-entrants 2. The studs 3*b* extend beyond the plane defined by the surface of the frame 1 forming the interface with the shell 3*a*. The studs 3*b* come into contact with the lateral faces of the vertical and horizontal battens so as to form the studs 3*b* that have an identical shape to the shape of the re-entrants 2 to enhance the strength of the wall panel. The connecting plate 3 is a breathable plate. The studs 3*b* oppose deformation of the frame 1. It is advantageous for the studs 3*b* to be embedded in the re-entrant 2 over at least 20% of the thickness of the re-entrant. The thickness is measured in a direction perpendicular to the plane defined by the longitudinal direction of vertical battens 1*a* and the horizontal direction of the horizontal battens 1*a*. It is particularly advantageous for the depth of embedment of the studs 3*b* in the re-entrant 2 to be less than 70% of the depth of the re-entrant 2, advantageously less than 50% of the depth of the re-entrant 2. It is also advantageous for the overlap thickness between the studs 3*b* and the frame 1 to be at least equal to 25% of the thickness of the frame 1. To form a wall panel able to support several storeys, it is advantageous for the overlap thickness between the studs 3*b* and the frame 1 to be at least equal to 60 mm.

It is particularly advantageous to provide a wall panel formed by the frame 1 and the connecting plate 3. The wall panel presents a compressive strength that is greater than or equal to 2 MPa and a shear strength that is at least equal to 0.5 MPa. Such values make it possible to envisage construction of buildings of one or more storeys, preferably less than four storeys.

Associating the connecting plate 3 with the frame 1 enables a wall panel to be formed that presents a better compressive strength than the frame 1 alone and than the connecting plate 3 alone. This association makes it possible to provide a wall panel that is lighter than its equivalent made from concrete or reinforced concrete and that is stronger than its equivalent made only from a wooden frame.

The connecting plate 3 protects the vertical battens 1*a* made of wood against fire. The wall panel has a better fire resistance than an equivalent construction made from wood. In case of fire, the connecting plate 3 resists better than a concrete plate and in particular a reinforced concrete plate, thereby preventing the concrete from bursting. The proposed configuration is simpler to achieve.

It is particularly advantageous to form a wall panel having a connecting plate 3 presenting a density of less than 1200 kg/m3 or even less than 1000 kg/m3 or 800 kg/m3 in order to have a wall panel that is easy to transport and to install. To obtain such a wall panel, it is advantageous to use a mixture of a curable material in which organic plant-derived elements are embedded. In preferential manner, the mixture comprises at least 50% by volume of organic plant-derived elements. Advantageously, the mixture comprises at least 75% by volume of organic plant-derived elements or even at least 85% by volume of organic plant-derived elements. Such a content of organic plant-derived elements enables a wall panel to be formed that is breathable with respect to water vapour, thereby facilitating construction of a building with a good hygrothermal regulation. Such a content of organic plant-derived elements enables a wall panel to be formed that is porous but has a used thickness enabling a rainproof and thermally efficient panel to be formed.

Under these conditions, the wall panel is particularly advantageous in comparison with other known materials. It enables a more efficient structure to be provided than an equivalent structure made from wood only. Such a structure is also lighter and more resistant to thermal shocks than an equivalent structure made from concrete or from reinforced concrete.

To produce an efficient wall panel, it is important to find the best trade-off between mechanical performance, size of the wall panel, weight of the panel, thermal resistivity between the outside wall and the inside wall, and thermal phase shift.

The use of wall panels having a thickness of the connecting plate 3 of at least 10 cm also provides a good sound absorption and a good airtightness and watertightness.

Using a mixture having mainly wood elements or organic plant-derived elements by volume means that the wall panel has a compressive strength before breaking that is higher than an equivalent wall panel made from concrete or reinforced concrete. It is therefore advantageous to reinforce the connecting plate 3 by means of the frame 1 while remaining lighter than a concrete panel. The high compressive strength of the connecting plate in the other directions associated with the studs 3*b* that press on the lateral walls of the vertical and horizontal battens provides a bracing that is efficient and lightweight and presents good thermal performances.

The connecting plate 3 has a sufficient thickness to fulfill a structural role. The frame 1 is installed fixedly attached to the connecting plate 3. The connecting plate 3 connects each of the vertical battens 1*a* mechanically. The vertical battens 1*a* extend vertically from one active end of the wall panel to the other.

What is meant by active end is the bottom end that is placed on a support and the top end that supports a roof or another storey. Preferentially, the connecting plate 3 is fixed directly to all the vertical battens 1*a*. In advantageous manner, the connecting plate 3 is fixed directly to all the horizontal battens 1*b*.

The connecting plate 3 has a minimum thickness at least equal to 5 cm, preferably at least equal to 8 cm, to ensure a higher compressive strength than a threshold value. It is particularly advantageous to have a thickness of less than 50 cm, preferably less than 40 cm and even more preferentially less than 30 cm. It is particularly advantageous to have a thickness of the shell 3*a* that is at least equal to 8 cm to achieve a large thermal phase shift between the two opposite walls of the connecting plate 3. It is advantageous to provide a shell 3*a* having a thickness comprised between 0.5 and 1.5 times the thickness of battens 1*a*/1*b* while ensuring the overlap conditions indicated above to provide an efficient bracing. It is advantageous for the thickness of the shell to be at least equal to 6 cm, i.e. for the connecting plate 3 to be salient from the frame by at least 6 cm, so as to ensure formation of a shell 3*a* that does not present a crack located facing a vertical batten and/or facing a horizontal batten. To limit the bulk of the wall, the thickness of the connecting plate 3 on each side of the frame is sought to be reduced. However, such a configuration results in the formation of a connecting plate 3 with a salient part that does not have a sufficient thickness to achieve the desired strength. By using a connecting plate 3 that partially overlaps the frame 1, i.e. only partially, a better trade-off can be achieved between the thickness of the connecting plate 3, the overall size, the strength and thermal displacement and/or sound-proofing performances.

The connecting plate 3 is preferentially thicker than the frame 1. The frame 1 is salient from one face of the connecting plate 3 to define a re-entrant 2 receiving the thermal insulation plate 4.

Depending on the configurations, the frame 1 can be located on the inner or outer face of the connecting plate 3.

Preferentially, the wall panel further comprises one or more thermal insulation plates 4. The thermal insulation plates 4 are installed in the re-entrants 2 of the frame 1. The thermal insulation plate 4 presents a thermal resistivity that is higher than or equal to the resistivity of the wood-concrete material forming the connecting plate 3. The thermal insulation plate 4 preferentially presents a mass density that is lower than that of the wood-concrete material and even more preferentially than that of wood. The thermal insulation plates 4 improve the global thermal resistance of the wall panel. It is advantageous for the sum of the thickness of the thermal insulation plate and of wood-concrete stud 3*b* to be equal to the height of the re-entrant 2. To improve the thermal resistance of the wall panel, it is preferable to install insulation plates made from a thermally insulating material presenting a thermal resistivity over density ratio (R/d) that is at least four times higher, preferably at least five times higher, than the same ratio of the material used to form the connecting plate. Such a material presents a good thermal resistivity but poor mechanical performances and a low thermal phase shift value. The thermal insulation is advantageously in the form of a wool.

In preferential manner, the wall panel is provided with a facing layer (not shown) that is separated from the connecting plate 3 by the frame 1 and the thermal insulation plate 4. The facing plate can be a plaster plate. The facing plate has a strength before breaking in the vertical direction that is lower than that of the frame 1 and lower than that of the connecting plate 3. The facing plate has a compressive strength that is at least five times lower than the compressive strength of the frame and at least twice as low as the compressive strength of the connecting plate, preferably at least five times lower. The weight of the facing layer represents less than 5% of the total weight of the wall panel.

The facing layer, the thermal insulation plate 4 and the connecting plate 3 are successively located in the thickness direction of the wall panel. The facing layer, the vertical battens 1*a* or the horizontal battens 1*a* and the connecting plate 3 are also located in the same thickness direction. In another configuration illustrated in FIG. 11, a counter-frame 6 is situated between the frame 1 and the facing plate.

The use of organic plant-derived elements embedded in a curable material enables a wall panel to be formed that presents a good fire resistance and forms a good insulator against temperature rises.

Associating the frame 1 with the connecting plate 3 enables a wall panel to be provided that presents a better trade-off between minimum compressive strength, weight and size.

In one configuration, the facing plate is fixed directly to the frame 1 and in particular to the vertical battens 1*a* and more particularly to all the vertical battens. As an alternative, the facing plate is fixed directly to a counter-frame 6 formed by additional horizontal battens such as those illustrated in FIG. 11 and preferentially fixed to all the horizontal battens. Preferentially, the horizontal battens are made from metal or wood. The horizontal battens of the counter-frame 6 are fixed to the vertical battens 1*a*.

The use of a counter-frame 6 provided with horizontal battens enables the facing plate and the frame 1 to be separated from one another, thereby protecting the facing plate when the frame 1 is deformed due the vertically exerted forces. This prevents the forces from being taken up by the facing plate to prevent the facing plate from breaking.

In a particular embodiment, a plurality of connectors 5 are fixed to each vertical batten 1*a* and/or horizontal batten 1*b*. Each connector 5 has an area of enlarged cross-section located at a distance from the frame 1. The area of enlarged cross-section is embedded in the connecting plate 3. The connectors 5 form keying devices that enhance attachment between the connecting plate 3 and the frame 1. Preferentially, the connectors 5 are embedded in the shell 3*a* of the connecting plate 3 having a thickness at least equal to 5 cm. The shell 3*a* has a thickness at least equal to 5 cm. The connectors 5 are preferentially made from metallic material, for example in the form of screws the head of which acts as the enlarged area performing mechanical securing between the connecting plate 3 and the frame 1. The shell 3*a* extends in a perpendicular direction at a distance from the frame 1. The frame 1 is placed on one face of the wood-concrete shell without being embedded in the wood-concrete shell. In an alternative, the vertical battens 1*a* and/or the horizontal battens 1*a* are textured so as to be unremovable from the connecting plate 3.

The stud 3*a* enhances the rigidity of the wall panel. This enables a part of the horizontal forces to be taken up to reinforce the bracing of the frame 1 and reduce the deformation of the wall face. Such horizontal forces can arise when the wind speed is high and/or when earth tremors occur.

In a particularly advantageous configuration, the vertical battens 1*a* are installed on a shell 3*a* having a thickness at least equal to 5 cm, preferably at least equal to 8 cm. The shell 3*a* can present recesses for installation of the joinery. The shell 3*a* connects the wood-concrete studs 3*b* mechanically to reinforce the strength of the wall panel.

In preferential manner, the spaces existing between the vertical battens 1*a* are partially filled by thermal insulation plates 4. It is advantageous for the thickness of the vertical battens 1*a* to be larger than or equal to the sum of the thickness of the wood-concrete studs 3*b* and of the thickness of the thermal insulation plate 4. Preferentially, the thickness of the vertical battens 1*a* is equal to the sum of the thickness of the wood-concrete studs 3*b* and of the thickness of the thermal insulation plate 4. In an advantageous configuration, the space defined between the vertical battens is completely filled by the wood-concrete studs 3*b* and thermal insulation plates 4.

The thermal insulation plate 4 presents a higher thermal resistivity than the thermal resistivity of the material forming the connecting plate 3. Associating the connecting plate 3 and the thermal insulation plate 4 enables a wall panel with an improved thermal resistance to be provided at equivalent thickness.

Advantageously, the plurality of horizontal battens 1*b* comprise a top wall plate extending continuously from one end of the connecting plate 3 to the other.

It is also advantageous for the wall panel to have a bottom wall plate that is formed by one of the horizontal battens 1*a* of the frame 1.

In preferential manner, a second plurality of connectors is fixed to the top wall plate, each connector having a salient area located at a distance from the top wall plate, the salient area being embedded in the shell 3*a*.

The use of such wall panels having a thickness of the connecting plate 3 of at least 10 cm achieves a thermal inertia estimated at about 0.6 h/cm and a specific heat capacity of more than 1000 J/Kg/K.

The wall panels are self-supporting and have a higher structural strength than a threshold value to be able to support several storeys erected thereon. It has been observed that this wall panel configuration enables constructions having five levels to be formed, i.e. a ground floor and four storeys.

To provide a connecting plate 3 presenting improved mechanical and thermal performances, the wood-concrete shell 3*a* and the studs 3*b* belong to a single unremovable monolithic part. Preferentially, they are formed simultaneously in a single moulding step.

Manufacture of the wall panel can comprise the following successive steps. A frame 1 is provided having the future vertical battens 1*a*. The vertical battens 1*a* are preferentially fixed to one another by means of one or more horizontal battens 1*b*, preferentially at least two horizontal battens 1*b*, to form a framework procuring a certain mechanical strength. A mould designed to receive the frame 1 is provided.

A plurality of blanking plates, preferentially plates 4 made from thermally insulating material, are installed in the frame 1. The blanking plates preferably fill each of the cavities existing in the frame. As indicated in the foregoing, it is advantageous for thermal insulation plates 4 not to fill the cavity completely so that a wood-concrete stud 3*a* can be formed.

Figure 2:
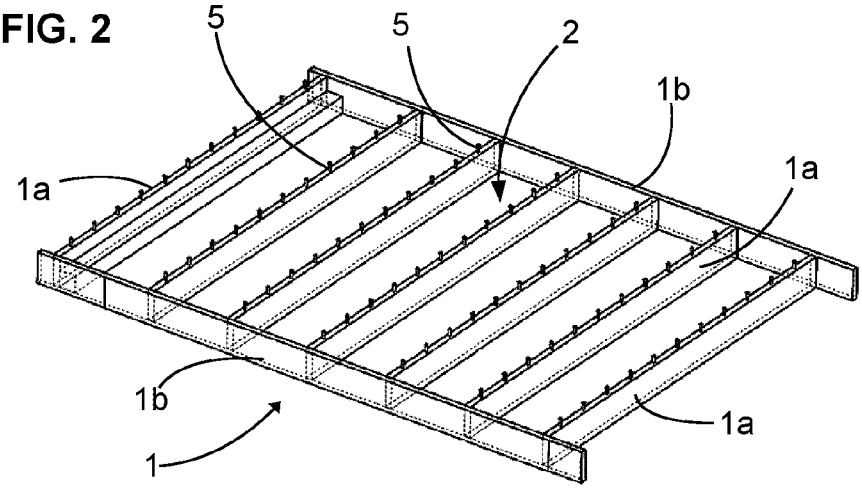
FIG. 2 schematically illustrates a perspective view of a frame.
Figure 3:
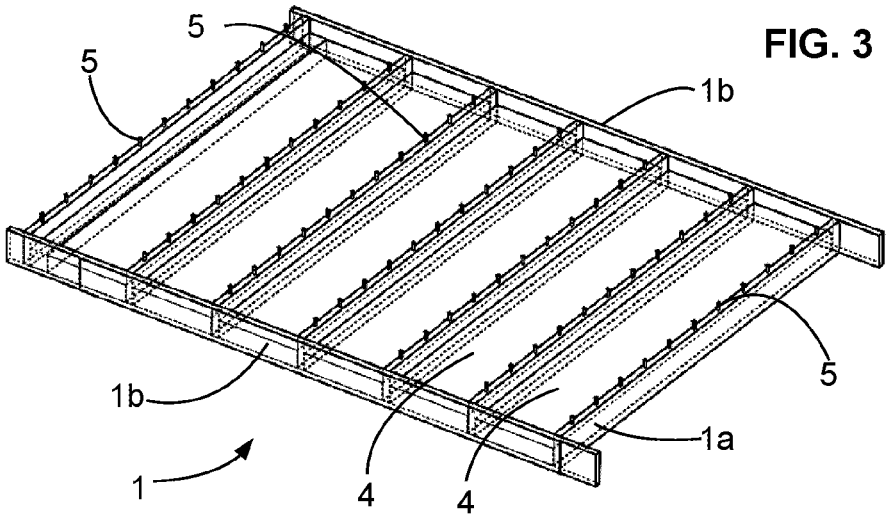
FIG. 3 schematically illustrates a perspective view of a frame the spaces of which are filled by a thermal insulator.

As illustrated in FIGS. 2 and 3, the frame 1 is topped by a plurality of connectors 5, for example the connectors 5 screw-fastened into the vertical battens 1*a*.

Figure 4:
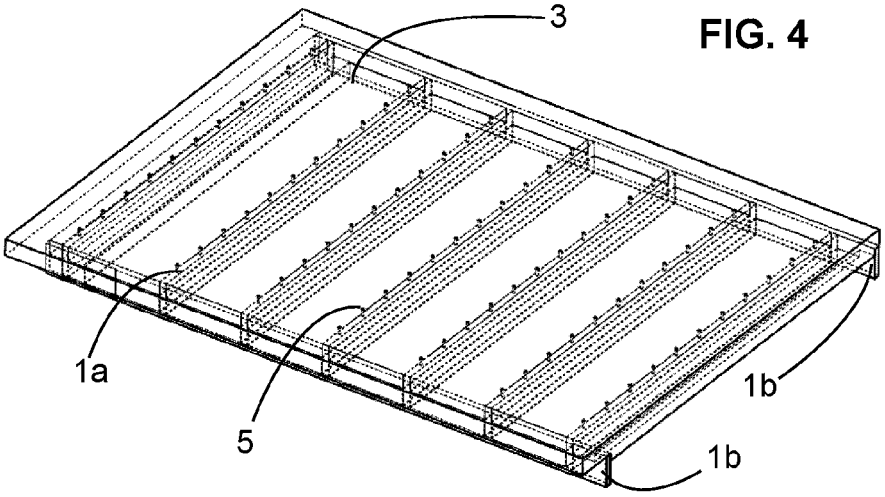
FIG. 4 schematically illustrates a perspective view of a frame covered by a connecting plate.

A mixture of a curable material in which organic plant-derived elements are embedded is cast in the mould containing the frame 1 and the blanking plates. Once the mixture has hardened, the wall panel illustrated in FIG. 4 can be extracted from the mould. As an alternative, the thermal insulation plate 4 partially fills the holes and is kept.

Figure 5:
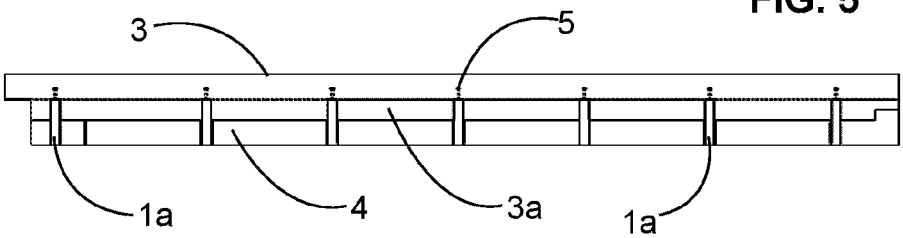
FIG. 5 schematically illustrates a sectional view of a wall panel comprising a connecting plate, a frame and thermal insulation plates.
Figure 8:
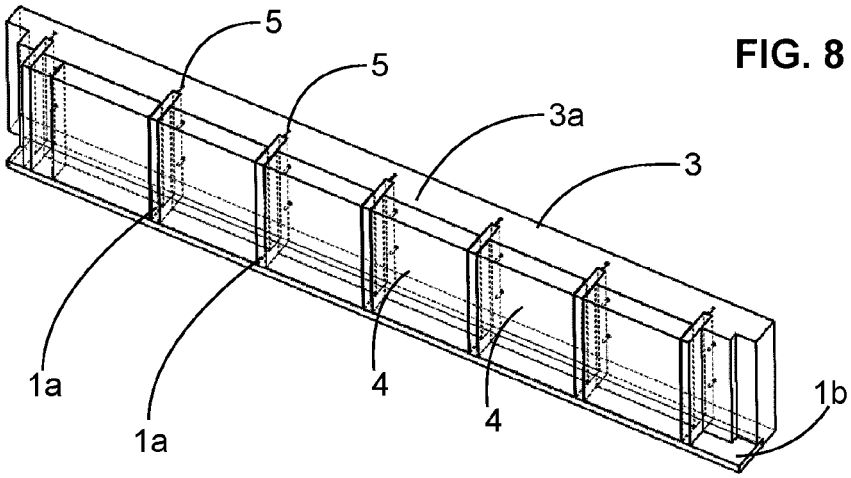
FIG. 8 schematically illustrates a sectional view of a wall panel.

FIGS. 5 and 8 illustrate a sectional view of the wall panel. One face of the wall panel is formed by the frame 1 and the thermal insulation plates 4. The other face is formed by the connecting plate 3. The connectors 5 fixed to the frame 1 are embedded in the connecting plate 3 without passing through the connecting plate 3. The connectors 5 perform mechanical transmission of forces between the frame 1 and the connecting plate 3.

The wood-concrete studs 3*a* and the thermal insulation plates 4 fill the space inside the frame 1 so as to improve the thermal resistance without increasing the bulk of the wall panel.

Figure 6:
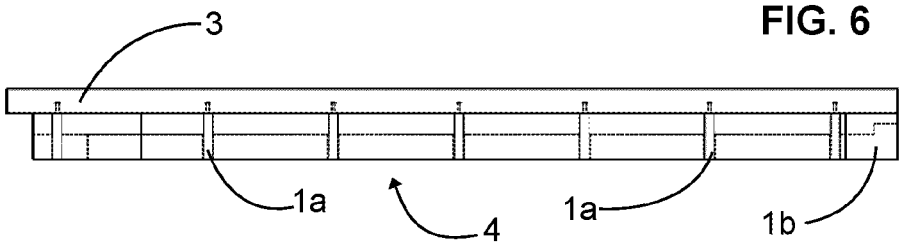
FIG. 6 schematically illustrates a top view of a wall panel comprising a connecting plate, a frame and thermal insulation plates.
Figure 7:
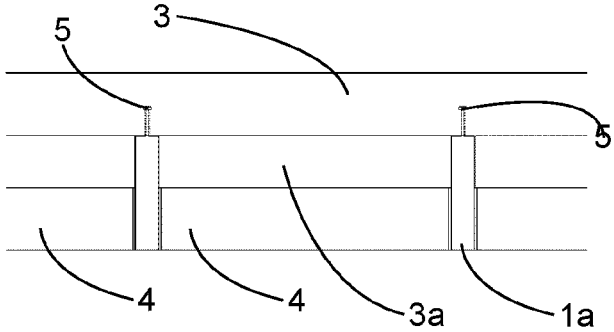
FIG. 7 schematically illustrates an enlarged sectional view of the wall panel.

FIG. 6 illustrates a top view of the wall panel. It is particularly advantageous for the wall panel to have a top wall plate and a bottom wall plate that are formed by the horizontal battens 1*a* of the frame 1. As an alternative, the top wall plate and bottom wall plate are fixed directly to the frame 1 to facilitate transmission of forces.

Figure 12:
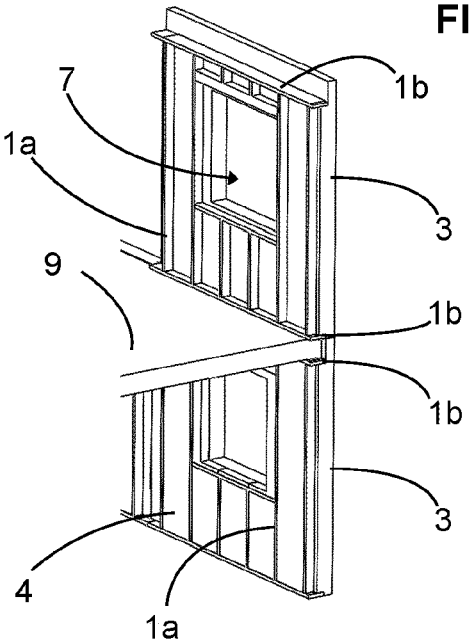
FIG. 12 schematically illustrates a perspective view of two wall panels installed one above the other.

It is also advantageous for the top wall plate to be designed to support the slab of the upper level as illustrated schematically in FIG. 12.

Figure 9:
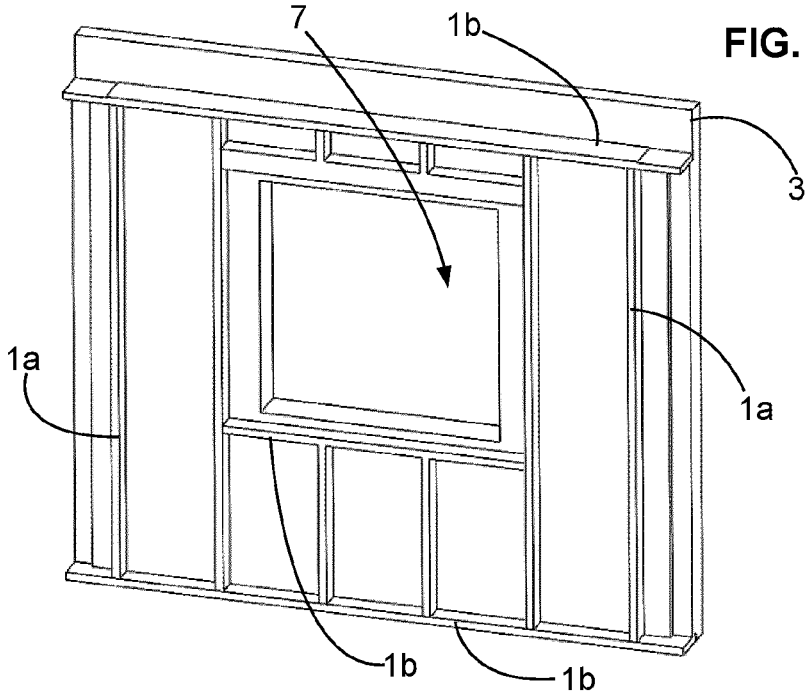
FIG. 9 schematically illustrates a perspective view of a vertically erected wall panel with a re-entrant.

As indicated in the foregoing, it is advantageous for the wall panel not to comprise through holes so as to procure optimal mechanical and thermal performances. However, as illustrated in FIG. 9, it is also possible to provide for the wall panel to have a re-entrant 7 that can receive a window, a bay window, a door or any other suitable fitting. To procure an appropriate strength, it is advantageous to provide for the frame to have the horizontal battens 1*a* that will support the installed element.

When the wall panel is formed, it is advantageous to fill a part of the mould with a blanking element to define the re-entrant. It is also advantageous not to use a thermal insulation plate 4 in this area. As the connecting plate 3 can easily be cut, the dimensions of the through hole can be adjusted to match requirements at the last minute.

In preferential manner, the wood-concrete shell 3*a* projects out beyond the frame 1. It is advantageous for the shell 3*a* to come flush with the frame on one end and to overshoot the frame on the opposite end in the horizontal and/or vertical direction. Such a configuration makes it easier to associate panels to form a construction.

Figure 10:
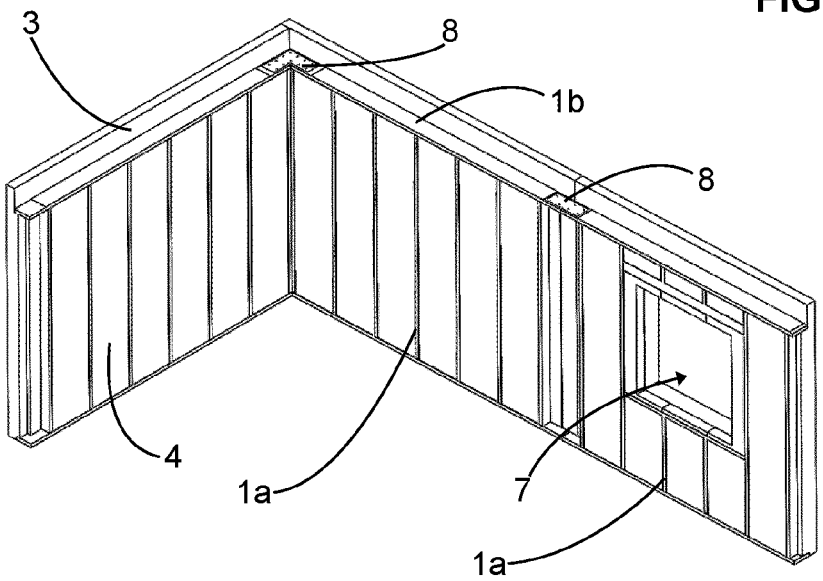
FIG. 10 schematically illustrates a perspective view of a set of vertically erected wall panels.

In preferential manner, different shapes of wall panels are made so as to define wall panels to form corners, wall terminations or wall continuities. FIG. 10 illustrates a construction comprising three wall panels fixed to one another. Two wall panels form a corner, preferably a 90° corner. Two of the wall panels are installed in the continuity of their lateral faces.

Figure 11:
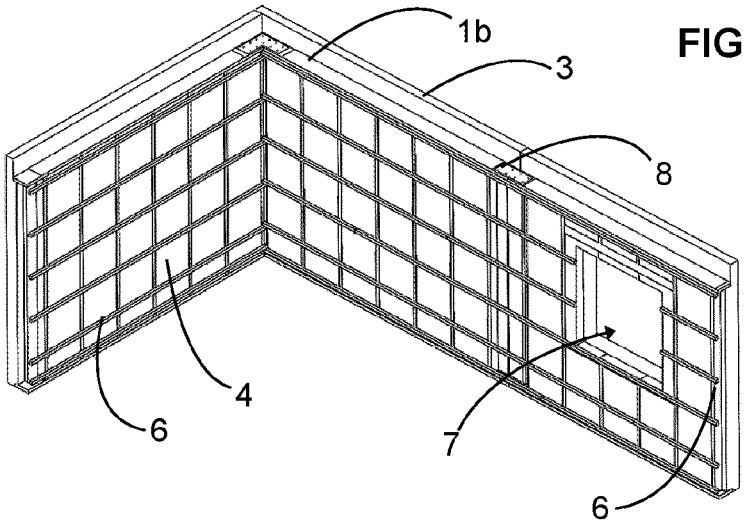
FIG. 11 schematically illustrates a perspective view of a set of vertically erected wall panels covered by a counter-frame.

In advantageous manner, the wall panels are fixed to one another by their horizontal battens 1*b* and preferentially by the top and/or bottom wall plates as illustrated in FIGS. 10 and 11. In the embodiments illustrated in FIGS. 10 and 11, the wall panels are fixed two by two by means of a fastening element 8, for example metal plate associated with screws, bolts, rivets or any other equivalent means.

As an alternative or as a complement, two adjacent wall panels of the same level are fixed to one another by means of a wooden upright. The two wooden frames 1 are fixed to the wooden upright.

In particularly advantageous manner, once the wall panels have been fixed to one another, the panels are secured by means of the counter-frame 6 that extends over at least two panels installed in the continuity of their lateral faces, i.e. with lateral faces that only form a single external or internal plane.

It is preferable to provide a sealing element that connects the bottom connecting plate with the top connecting plate. Tight sealing can be obtained by means of a mortar-adhesive layer. It is also advantageous to use a sealing element that connects two adjacent wall panels of the same level.

FIG. 12 illustrates a part of a construction where two wall panels are erected on one another. A slab 9 is present between the two wall panels. The slab 9 is installed bearing on the frame 1 so that the stresses applied by the slab 9 are mainly taken up by the frame 1. In the illustrated example, the slab 9 is placed on the top wall plate of the bottom wall panel. The bottom wall plate of the top wall panel is bearing on the slab 9.

To improve the thermal performances of the construction, the connecting plate 3 of the bottom and top wall panels join one another and the two wall panels define a groove designed to receive the slab 9. As illustrated in FIGS. 1, 9, 10, 11 and 12, the connecting plate 3 extends vertically beyond the top wall plate to provide insulation over a part of the height of the slab, the height being measured vertically in the construction. It is also advantageous for the connecting plate 3 to extend below the bottom wall plate to cover a part of the slab. The wood-concrete plates of the two wall panels are installed one above the other and join one another to form a thermal insulation layer that blocks a part of the thermal flux between the slab and the outside of the construction.

As the wood-concrete material is easier to cut than concrete, it is easy to define the shape of the connecting plate 3 to adjust to compensate manufacturing uncertainties or imponderables. For example purposes, the wall panels are manufactured by default with a connecting plate 3 that extends underneath the bottom wall plate and above the top wall plate. The extension of the connecting plate 3 beyond the bottom wall plate is cut to form the bottom wall panel that is deposited on a support, for example on a slab as illustrated in FIG. 12.

Figure 13:
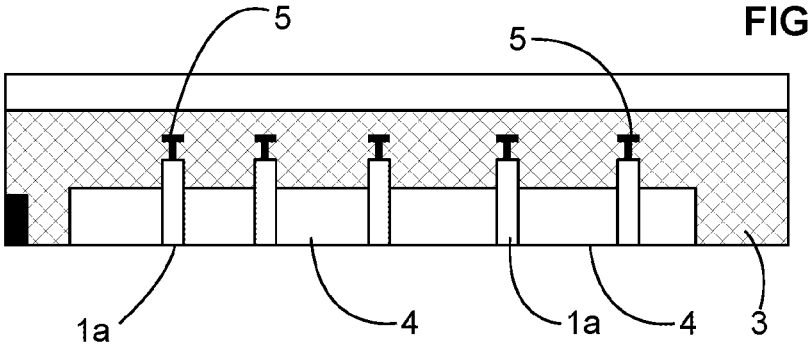
FIG. 13 schematically illustrates a casting step of a mixture in a mould comprising a frame and thermal insulation plates.

In advantageous manner, the slab 9 is cast using the top wall plate and the salient part of the connecting plate 3 to form a part of the mould of the slab 9. FIG. 13 illustrates casting of a mixture in a mould in which the frame 1 and thermal insulation plates 4 are installed.

The construction has a first level that has a ring formed by a plurality of wall panels such as those described in the foregoing. A slab 9 is cast in a mould. The contour of the mould is formed by the top wall plates and the top end of wood-concrete plates 3. In this way, the concrete mixture forming the slab extends up to the ends of the wall panels.

When the slab 9 is cast directly on the tops of the wall panels, it is advantageous to fix the connectors 5 to top wall plate 1*b*.

As an alternative, the slab 9 can be prefabricated. Once the slab 9 has dried, the latter is placed on the top of the frame 1. The slab 9 is preferentially fixed to the frame 1.

In an alternative embodiment, thermal insulation plates 4 are not installed in the holes of the frame 1 when the mixture is cast. Once the wall panel has been installed, thermal insulation plates 4 are installed in the holes of the frame 1. Blanking plates are installed in the mould to fill the re-entrants 2 of the frame 1 when the mixture is cast.

Once the wall panel has been extracted from the mould, the blanking plates can be replaced by thermal insulation plates 4.

The wall panel is particularly advantageous as it is able to provide a high thermal resistance with a limited thickness. The astute association of the frame 1 and the connecting plate 3 procures a good strength for constructions of several storeys while being easy to build, economical and of limited weight.

The use of a connecting plate 3 provides a good fire resistance and at least partly protects the frame 1.

The invention claimed is:

1. A supporting wall panel comprising:

a frame provided with a plurality of vertical battens made from wood, the vertical battens extending mainly in a vertical direction and a plurality of horizontal battens extending mainly in a horizontal direction, each vertical batten being fixed to at least two of the horizontal battens, the frame having a first thickness in a first direction perpendicular to the vertical direction and perpendicular to the horizontal direction, the frame defining a plurality of re-entrants in the form of through holes in the first direction;

a connecting plate having a shell and studs extending from the shell, the shell and the studs being formed by a first mixture comprising a curable material in which organic plant-derived elements are embedded, the first mixture extending continuously from the shell to the studs, the connecting plate attaching all the vertical battens and all the horizontal battens to form a bracing of the frame;

wherein the organic plant-derived elements represent at least 70% of the volume of the connecting plate;

wherein the shell is arranged salient from the frame in the first direction and the studs protrude from the shell in the first direction to extend into the re-entrants;

wherein the studs are in contact with lateral faces of the vertical battens and the horizontal battens; and wherein the studs define an area covered by the first mixture and an area not covered by the first mixture, the studs extending into the plurality of re-entrants by at least 20% of a depth of the plurality of re-entrant and less than 70% of the depth of the plurality of re-entrant along the first direction so that the connecting plate and the frame define a plurality of blind holes, shell, the connecting plate having a vertical compressive strength at least equal to 1 MPa.

2. The wall panel according to claim 1 wherein the connecting plate extends out from the frame over a distance at least equal to 6 cm.

3. The wall panel according to claim 1 wherein the connecting plate is fixed to the frame by means of a plurality of connectors.

4. The wall panel according to claim 3 wherein the connecting plate is fixed directly to all the vertical battens.

5. The wall panel according to claim 3 wherein the connecting plate is fixed directly to all the horizontal battens.

6. The wall panel according to claim 3 wherein each connector has a salient area located at a distance from the frame, the salient area being embedded in the connecting plate.

7. The wall panel according to claim 1 wherein a thickness of the shell is at least equal to 5 cm.

8. The wall panel according to claim 1 wherein the studs extend over at least 25% of the depth of the re-entrant and no more than 50% of the depth of the re-entrant.

9. The wall panel according to claim 1 wherein the re-entrant is filled by a thermal insulation plate that presents a thermal resistivity over density ratio at least four times higher than the thermal resistivity over density ratio of the material forming the connecting plate.

10. The wall panel according to claim 1 comprising an additional frame fixed to the frame and separated from the connecting plate by the frame, the additional frame only comprising horizontal battens, a facing plate being fixed to the additional frame.

11. The wall panel according to claim 10 wherein one of the horizontal battens forms a bottom wall plate, the wall panel being pressing on the bottom wall plate.

12. The wall panel according to claim 1 wherein one of the horizontal battens forms a top wall plate extending continuously from one end of the connecting plate to the other.

13. The wall panel according to claim 12 wherein the connecting plate extends beyond the top wall plate in the vertical direction.

14. A construction comprising a first wall panel according to claim 13 wherein a slab is placed on the top wall plate and wherein a second wall panel is placed on the slab, a bottom wall plate of the second wall panel being installed bearing on the slab.

15. A method for manufacturing a wall panel according to claim 1 comprising the following successive steps:

providing a frame provided with wooden vertical battens and horizontal battens, the frame defining holes;

providing blanking plates;

casting a first mixture of a curable material in which organic plant-derived elements are embedded, the first mixture being cast in a mould in which the frame is installed with the blanking plates partially filling the holes of the frame to form re-entrants, the first mixture being cast to form a connecting plate connecting all the vertical battens and all the horizontal battens, the organic plant-derived elements representing at least 70% of the volume of the connecting plate;

wherein the connecting plate partially and continuously overlaps the vertical battens in a thickness direction perpendicular to the horizontal direction and perpendicular to the vertical direction, the connecting plate having a shell arranged salient from the frame in the thickness direction and studs salient from the shell, the studs partially filling the plurality of re-entrants, the connecting plate having a vertical compressive strength at least equal to 1 MPa.

16. The wall panel according to claim 1 wherein the curable material is mortar and the organic plant-derived elements are wood chips.

17. The wall panel according to claim 1 wherein the studs that have an identical shape to a shape of the re-entrants when observed in the first direction.

* * * * *